US008132584B2

(12) United States Patent
Lane et al.

(10) Patent No.: US 8,132,584 B2
(45) Date of Patent: Mar. 13, 2012

(54) UNIVERSAL GAZEBO COVER

(76) Inventors: Patrick Lane, Lake Mary, FL (US); Martin Denney, Lake Mary, FL (US)

( * ) Notice: Subject to any disclaimer, the term of this patent is extended or adjusted under 35 U.S.C. 154(b) by 181 days.

(21) Appl. No.: 12/578,833

(22) Filed: Oct. 14, 2009

(65) Prior Publication Data

US 2010/0275959 A1 Nov. 4, 2010

Related U.S. Application Data

(60) Provisional application No. 61/175,299, filed on May 4, 2009.

(51) Int. Cl.
*E04H 15/54* (2006.01)

(52) U.S. Cl. ..... 135/115; 135/95

(58) Field of Classification Search ..... 135/115, 135/119, 120.1, 120.2, 120.3, 95, 97
See application file for complete search history.

(56) References Cited

U.S. PATENT DOCUMENTS 1,249,883 A * 12/1917 Baldwin ..... 135/94
1,599,798 A * 9/1926 Stockton ..... 2/89
3,406,698 A * 10/1968 Hutchison ..... 135/92
3,896,830 A * 7/1975 Sharick ..... 135/93
3,953,949 A * 5/1976 O'Sheeran ..... 52/82
4,033,367 A * 7/1977 Johnston ..... 135/100
4,784,172 A * 11/1988 Yacoboni ..... 135/87
5,769,106 A * 6/1998 Achuff ..... 135/95
6,338,356 B1 * 1/2002 Wallenstatter ..... 135/100
6,988,505 B2 * 1/2006 Powell et al. ..... 135/128
2008/0099060 A1 * 5/2008 Stocking et al. ..... 135/115

* cited by examiner

*Primary Examiner* — Noah Chandler Hawk
(74) *Attorney, Agent, or Firm* — Shumaker, Loop & Kendrick, LLP

(57) ABSTRACT

A gazebo cover adaptable for gazebos having different sized canopies include a fabric panel having a central opening and a perimeter defining at least three adjacent perimeter portions. The fabric panel includes a plurality of centrally-converging gussets extending between the perimeter and the central opening. A closure, for example, a slide zipper, is provided for selectively opening the gussets to form a relatively large canopy sized to fit a predetermined large size canopy frame, and for selectively closing the gussets to form a relatively small canopy sized to fit a predetermined small size canopy frame. A peak cap is positioned over and attached to the central opening of the fabric panel for closing the central opening.

17 Claims, 6 Drawing Sheets

UNIVERSAL GAZEBO COVER

CROSS REFERENCE TO RELATED APPLICATIONS

This patent application claims the benefit of priority of, and incorporates by reference herein, U.S. provisional patent application Ser. No. 61/175,299, filed on May 4, 2009, entitled "Universal Gazebo Cover."

TECHNICAL FIELD AND BACKGROUND OF THE INVENTION

This invention relates to a universal fabric gazebo cover that permits use on two or more of the most commonly-sized gazebos. As used in this application to describe the preferred embodiments, the term "gazebo" describes a quadralinear structure having four legs, which may be vertical or slanted inwardly towards the center, onto which is fastened a fabric cover. Typical sizes are a 10'×10' (100 $ft^2$) straight leg gazebo and a 12'×12' (81 $ft^2$) slanted leg gazebo. However, the cover disclosed in this application is intended to encompass use on gazebos and similar structures, by whatever name used to describe them, without regard to size or shape. The two examples referred to above are used for purposes of illustration only The fabric covers supplied with the gazebo when purchased new are subject to wear and deteriorization over time due to exposure to weather and the environment, particularly UV light. Given the variety of shapes and sizes available, retail sellers of gazebos often do not stock a variety of cover sizes, making it difficult and expensive to purchase a replacement cover when the original cover has reached the end of its useful life. When such replacement covers are available, it is often from the original gazebo manufacturer, and the cost of the replacement cover can sometimes be almost as much as purchasing an entire new gazebo frame and cover.

BRIEF SUMMARY OF THE INVENTION

Therefore, it is an object of this invention to provide a cover which includes features that make it easily adaptable to gazebos of more than one size. The appearance is essentially the same on all sizes, giving the installed cover a "custom" look at less cost than purchasing a true custom cover from the gazebo manufacturer.

It is another object of the invention to provide a cover that is adaptable to gazebos of more than one size, and that is quickly and easily installed.

These and other objects and advantages of the invention are achieved by providing a cover that includes a fabric canopy sized to conformably fit onto the roof frame of a predetermined large size gazebo. The canopy includes a plurality of spaced-apart gussets that extend between the periphery of the canopy towards its geometric center. When on the large size gazebo, the gussets are spread into a taut condition generally in the same plane as the rest of the canopy.

To fit the canopy onto a relatively smaller size gazebo, the gussets are folded on themselves by closure devices, such as zippers, touch fasteners or the like that extend along opposed edges of the gussets. When closed, the canopy is reduced in size by a predetermined amount that results in the canopy conformably fitting onto the roof of the smaller size gazebo. The cover may include a peak cap that is placed over the center of the canopy at the apex of the canopy and secured in place to cover any opening at the apex of the canopy. The peak cap and canopy may include complementary attachment devices to secure the peak cap in place, including attachment devices positioned to function when the canopy is in its large and reduced-size configurations.

In at least one embodiment, a gazebo cover adaptable for gazebos having different sized canopies includes a fabric panel having a central opening and a perimeter defining at least three adjacent perimeter portions, the fabric panel including a plurality of centrally-converging gussets extending between the perimeter and the central opening, a closure secured to the fabric panel along the length of the gusset for selectively opening the gussets to form a relatively large canopy sized to fit a predetermined large size canopy frame, and for selectively closing the gussets to form a relatively small canopy sized to fit a predetermined small size canopy frame, and a peak cap for being positioned over and attached to the central opening of the fabric panel for closing the central opening.

In at least one example, the closure comprises a continuously extending closure.

In at least one example, the closure comprises a zipper.

In at least one example, the peak cap includes relatively central connectors for attaching the peak cap to the fabric panel when the relatively small canopy is formed and relatively peripheral connectors for attaching the peak cap to the fabric panel when the relatively large canopy is formed.

In at least one example, the peak cap includes stress-spreading panels attaching the relatively central connectors and the relatively peripheral connectors to the peak cap.

In at least one example, the stress-spreading panels are three sided.

In at least one example, straps are secured to edges of the gussets for gathering the gussets when the relatively small canopy is formed.

In at least one example, straps are secured to centers of the gussets for securing the fabric panel to the large size canopy frame when the relatively large canopy is formed.

In at least one other embodiment, a gazebo cover adaptable for gazebos having different sized canopies, includes a fabric panel having a central opening and a perimeter defining at least three adjacent perimeter portions, the fabric panel including a plurality of centrally-converging gussets extending between the perimeter and the central opening, a closure secured to the fabric panel along the length of the gusset for selectively opening the gussets to form a relatively large canopy sized to fit a predetermined large size canopy frame, and for selectively closing the gussets to form a relatively small canopy sized to fit a predetermined small size canopy frame, a peak cap for being positioned over the central opening of the fabric panel for closing the central opening, relatively central connectors secured to the peak cap for attaching the peak cap to the fabric panel when the relatively small canopy is formed, and relatively peripheral connectors secured to the peak cap for attaching the peak cap to the fabric panel when the relatively large canopy is formed.

In at least one example, connectors are secured to the fabric panel for connecting to the relatively central connectors to attach the peak cap to the fabric panel when the relatively small canopy is formed and for connecting to the relatively peripheral connectors to attach the peak cap to the fabric panel when the relatively large canopy is formed.

In at least one example, stress-spreading panels attach the relatively central connectors and the relatively peripheral connectors to the peak cap.

In at least one example, the stress-spreading panels are three sided.

In at least one example, each stress-spreading panel is secured to the fabric panel along one of its three sides and one of the connectors at a junction of its other two sides.

In at least one example, there is one relatively central connector and one relatively peripheral connector between any two nearest gussets.

In at least one other embodiment, a gazebo cover adaptable for gazebos having different sized canopies, includes a fabric panel having a central opening and a perimeter defining at least three adjacent perimeter portions, the fabric panel including a plurality of centrally-converging gussets extending between the perimeter and the central opening, a closure secured to the fabric panel along the length of the gusset for selectively opening the gussets to form a relatively large canopy sized to fit a predetermined large size canopy frame, and for selectively closing the gussets to form a relatively small canopy sized to fit a predetermined small size canopy frame, a peak cap for being positioned over and attached to the central opening of the fabric panel for closing the central opening, straps secured to edges of the gussets for gathering the gussets when the relatively small canopy is formed; and straps secured to the centers of the gussets for securing the fabric panel to the large size canopy frame when the relatively large canopy is formed.

In at least one example, the straps comprise hook and loop fabric.

In at least one example, the straps are positioned as opposing pairs.

In at least one example, the straps secured to the edges of the gussets are long enough to gather the gussets and secure the fabric panel to the small size canopy frame.

In at least one example, straps as secured to the center of the peak cap for securing the peak cap to the small size canopy frame or the large size canopy frame.

In at least one example, the straps include hook and loop fabric.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENTS AND BEST MODE

Figure 1:
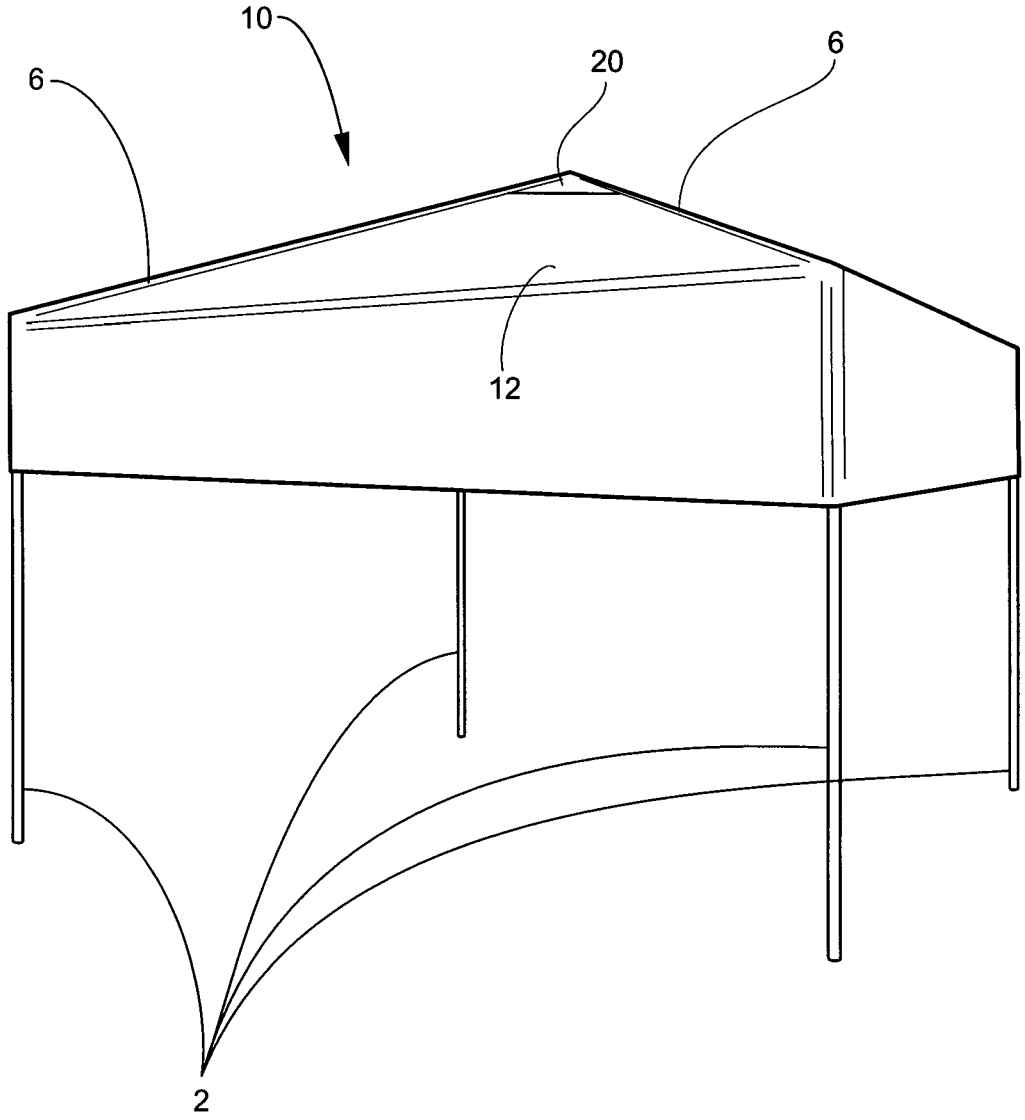
FIG. 1 is a perspective view of a gazebo and cover according to one embodiment of the invention.
Figure 4:
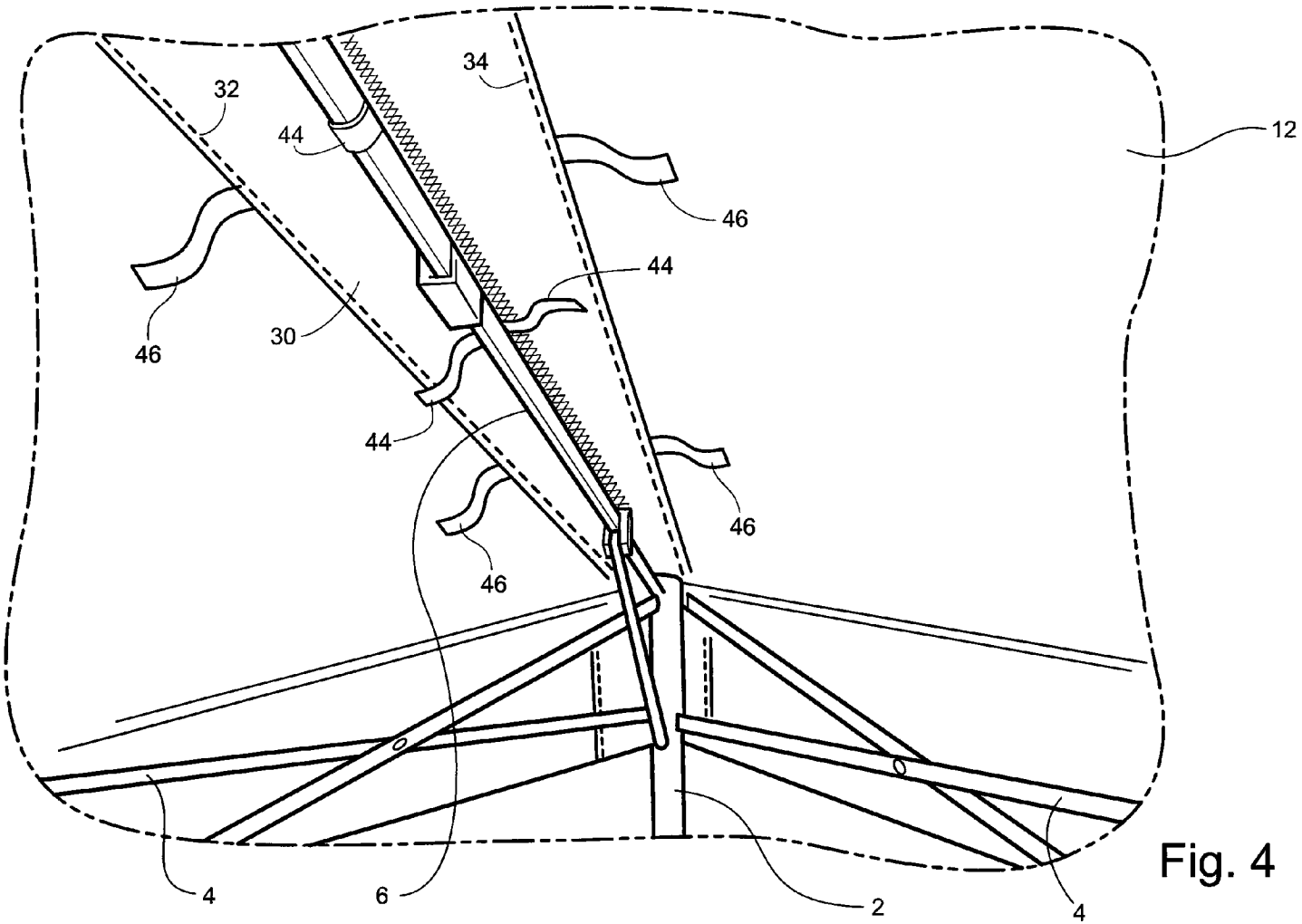
FIG. 4 is an underside view of a canopy according to an embodiment of the invention, showing attachment of the canopy to the gazebo frame.
Figure 6:
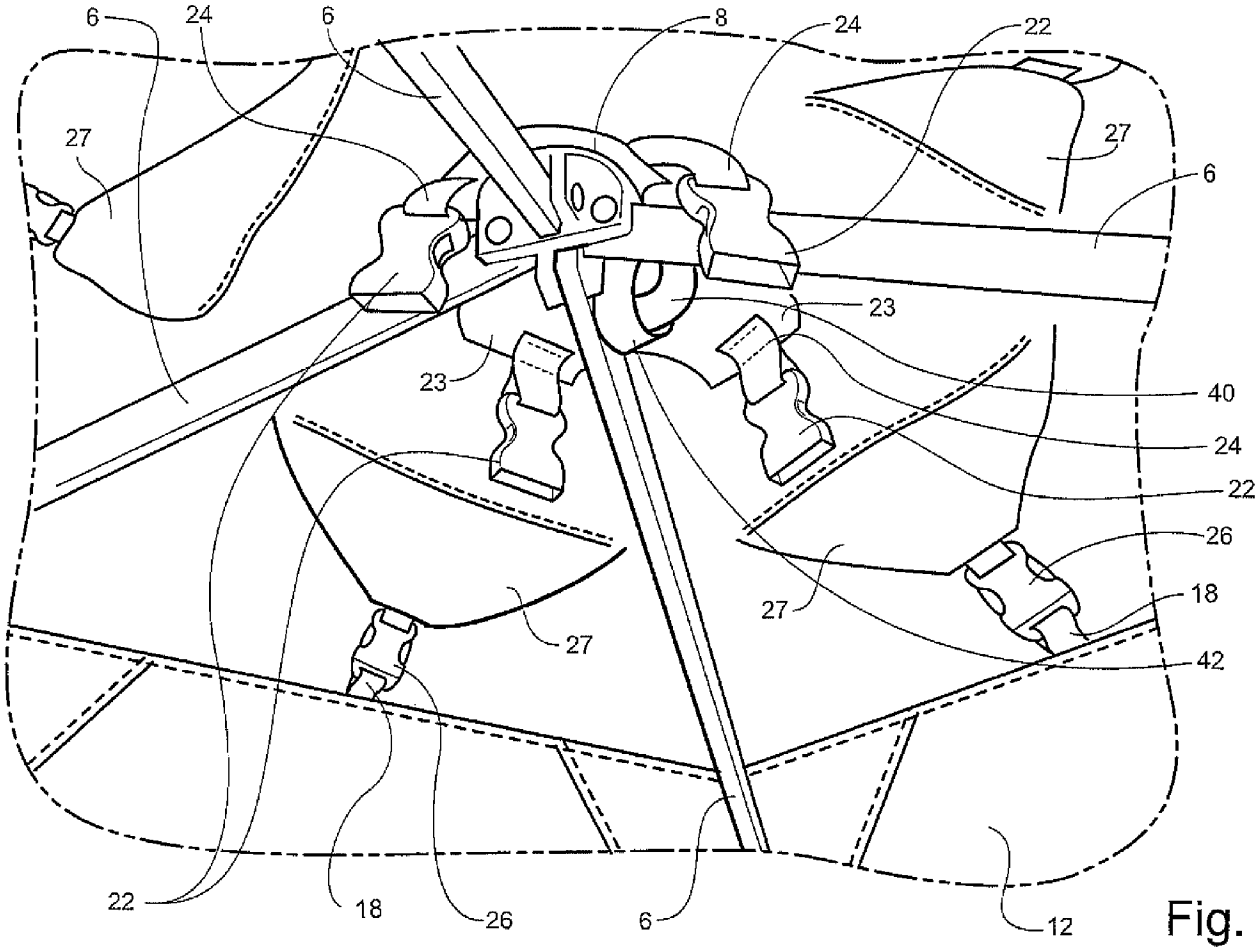
FIG. 6 is an overall underside view of the canopy showing attachment of the peak cap to the canopy.

Referring now specifically to the drawings, a gazebo canopy according to an embodiment of the present invention is shown generally in FIG. 1 at reference numeral 10. As discussed above, the canopy 10 can be sized and shaped for differing sized gazebos. As shown in FIGS. 1 and 4, a gazebo frame on which the canopy 10 is positioned for use includes four upright tubular legs 2 and four horizontally-extending connecting assemblies 4 that interconnect the legs 2. Four tubular ridge elements 6 extend upwardly and inwardly from four corners defined by the legs 2 to a raised, central point forming the apex of the gazebo frame, where they are bolted to a common bracket 8, as best shown in FIG. 6.

Figure 2:
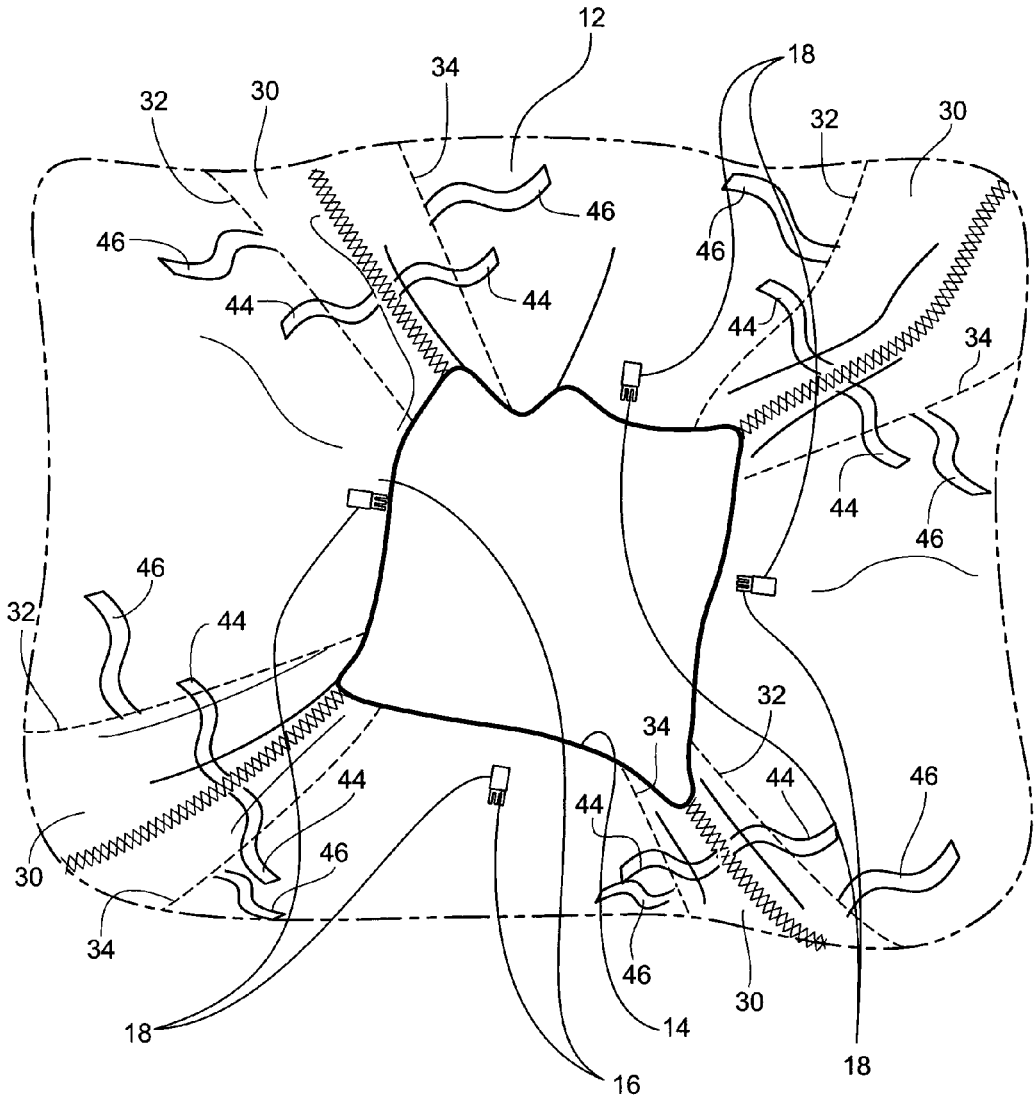
FIG. 2 is a partial view of the peak portion of the top of a canopy shown without a peak cap to illustrate the opening through the canopy according to one embodiment of the invention.

Referring now to FIG. 2, the canopy 10 is formed from a fabric panel 12, preferably a knitted fabric formed of high density, breathable polyethylene yarns, with the fabric preferably having a weight of about 200 $g/m^2 \pm 10$ $g/m^2$. This preferred weight is illustrative of a wide range of weights that would be suitable under varying conditions. The fabric is preferably treated with a UV inhibitor in order to retard degradation of the fabric resulting from UV exposure.

As is also shown in FIG. 2, the fabric panel 12 includes a generally quadralinear central opening 14. Four three-prong male side squeeze buckle elements 16 are attached by a short length of elastic fabric 18 to the underside of fabric panel 12 adjacent respective sides of the opening 14.

Figure 3:
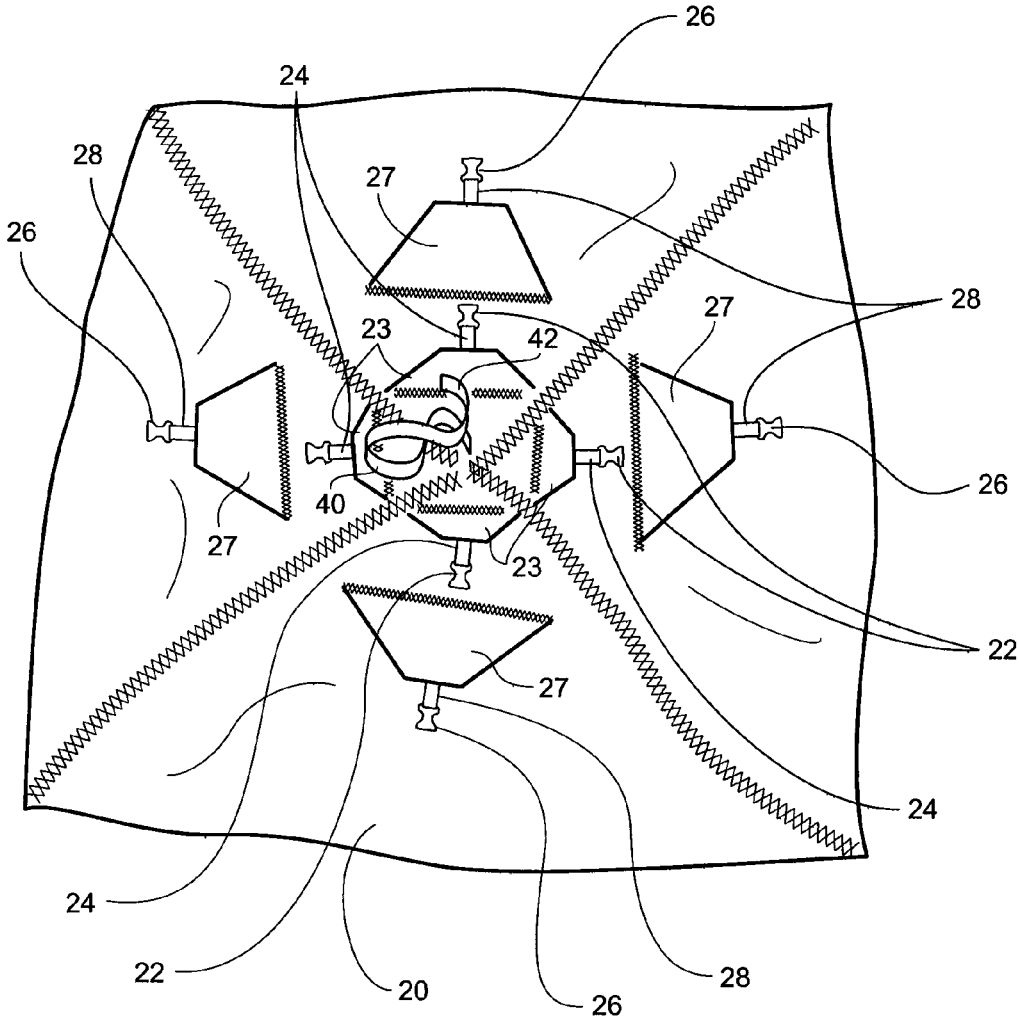
FIG. 3 is a bottom plan view of a peak cap according to one embodiment of the invention.

Referring now to FIG. 3, the opening 14 in the panel 12 is covered and overlapped by a peak cap 20, preferably formed of the same type of knitted fabric as the panel 12. The peak cap 20 is sized to allow use with the panel 12 in both a large and small configuration, as described in further detail below, and therefore includes two sets of four female side squeeze buckle elements complementary to the male buckle elements 16. As can be seen in FIG. 3, a first set of four female buckle elements 22 are attached by short lengths of elastic fabric 24 to the underside of the peak cap 20 in a rectangular orientation and spacing that match the orientation and spacing of the male buckle elements 16. A second set of female buckle elements 26 are attached by short lengths of elastic fabric 28 to the underside of the peak cap 20 in a rectangular orientation and spacing that also match the orientation and spacing of the male buckle elements 16, but which are offset towards the periphery of the peak cap 20, as shown.

The canopy 12 includes four tapered gussets 30 that extend from the corners of the canopy along ridge lines delineated by the ridge elements 6, one of which is shown in FIG. 2. The gussets 30 each include heavy-duty zipper including tracks 32, 34 along the outside surface of the canopy, and a slider, not shown, that enable the gussets 30 to be selectively opened and closed to conform to the desired gazebo frame. For example, to accommodate the 81 $ft^2$ frame, the gussets 30 are completely zipped closed, and the fabric taken up in the zipped area of the gussets 30 effectively reduces the footprint of the canopy 12 to fit the frame area.

Conversely, to accommodate the 100 $ft^2$ frame, the gussets 30 are unzipped, and the extra fabric, releasing the fabric and allowing it to spread as necessary to fit the larger frame area. Straps 44 are secured to the center lines of the gussets 30 as shown in FIG. 4 for securing the fabric panel 12 to the frame element 6 when the large canopy is formed. One set of straps 44 are shown secured to the frame element 6 in FIG. 4 and another set of straps 44 are shown free in order to illustrate the straps. To completely assemble a gazebo and secure the fabric panel 12 to the frame when the large canopy is formed, all of the straps 44 are preferable secured to the frame elements 6. Straps 46 are secured to the edges of the gussets 30 in order to gather and secure the gusset 30 when the small canopy is formed, whereas the gusset might otherwise drape down in an unaesthetic fashion. Thus, when the zipper tracks 32 and 34 are joined along the outside surface of the canopy, the material of the gusset can be rolled along the inside of the canopy and the material can be maintained in a roll by the straps 46, which are brought into close proximity as the zipper tracks 32 and 34 are joined. Straps 44 and 46 are provided in pairs to be joined such as by tying or by engaging them in pairs when hook and loop fabric are used in their construction.

To assemble the canopy 12 and install it on the desired frame, it is spread on a flat surface, such as the ground, patio, etc. and placed into its zipped closed or open condition as described above. The peak cap 20 is installed on the canopy by first placing it connecting the male side squeeze buckles 16 on the canopy 12 to the buckles 22 or 26 on the peak cap. For the 81 $ft^2$ frame, the male buckles 16 are connected to the matching female buckles 22, the buckles closest to the center of the peak cap 20. For the 100 $ft^2$ frame, the male buckles 16 are connected to the matching female buckles 26, the buckles farthest from the center of the peak cap 20. Thus, the female buckles 22 serve as relatively central connectors for attaching the peak cap to the canopy 12 when the smaller canopy is formed and the female buckles 26 serve as relatively peripheral connectors for attaching the peak cap to the canopy 12 when the large canopy is formed. The male buckles 16 serve as complementary connectors to either the connectors 22 or 26, securing the peak cap 20 to the canopy 12, depending on whether the small or large size canopy is formed.

The connectors 22 and 26 are attached to the peak cap by stress-spreading panels 23 and 27, respectively. The stress-spreading panels 23, 27 are three sided, each having a wide base attached to the peak cap 20 for spreading forces occurring between the peak cap 20 and the connectors 22, 26. Each stress-spreading panel 23, 27 has a more narrow free end connected to a connector 22, 26.

Figure 5:
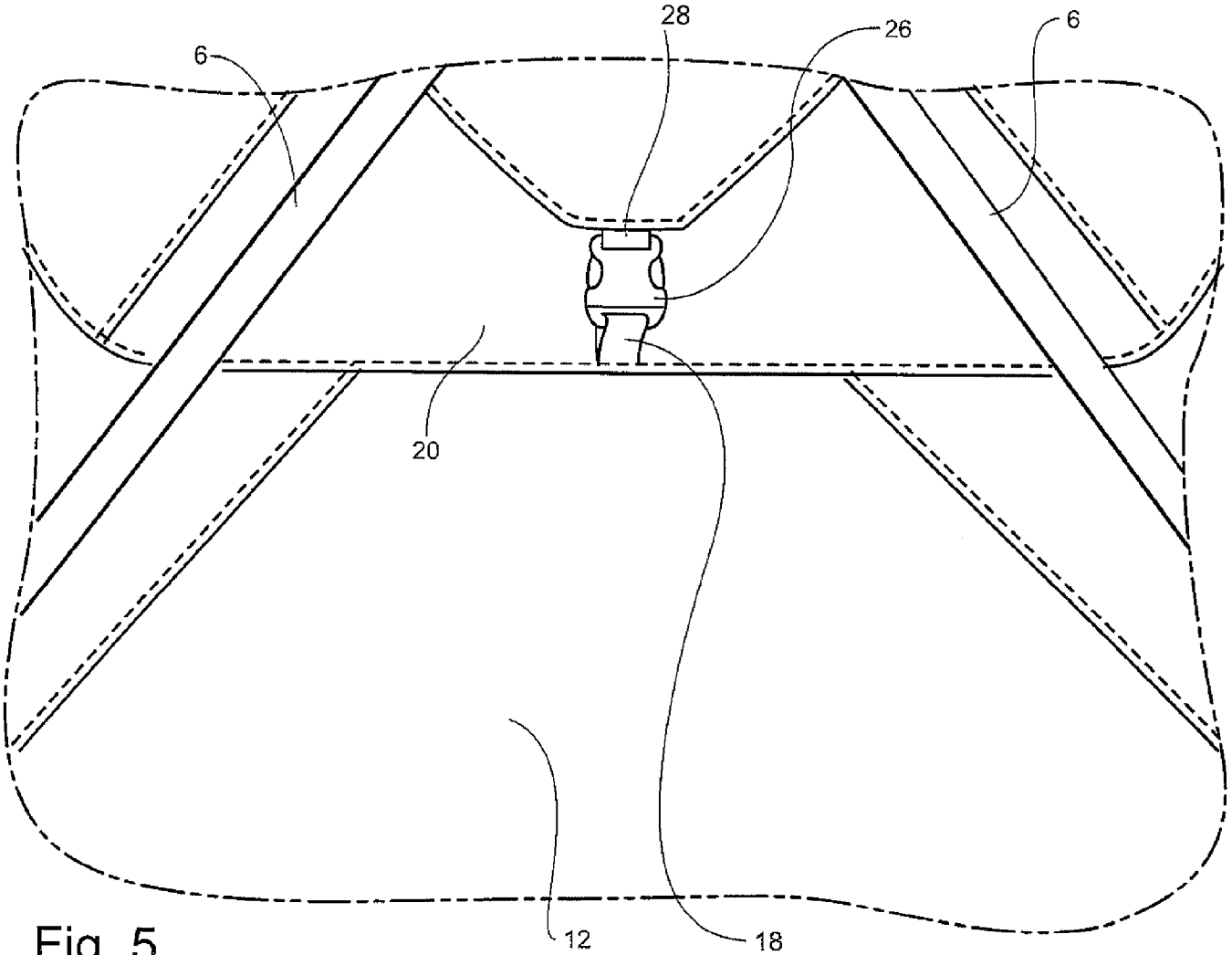
FIG. 5 is an underside view of the canopy showing attachment of one side of the peak cap to the canopy.

As shown in FIG. 5, the peak cap 20 overlaps the central opening 14 in the canopy 12. FIG. 6 illustrates the correct attachment for the 100 $ft^2$ frame. After all four of the female buckles 26 have been connected to the male buckles 16, the peak cap 20 and the attached canopy 12 is secured to the top of the frame by a pair of hook- and loop belts 40, 42 that are wrapped around the tubular ridge elements 6 and the bracket 8 and connected, thereby holding the peak cap 20 onto the ridge elements.

An improved universal gazebo cover is described above. Various details of the invention may be changed without departing from the scope of the invention. Furthermore, the foregoing description of the preferred embodiment of the invention and best mode for practicing the invention are provided for the purpose of illustration only and not for the purpose of limitation, the invention being defined by the claims.

What is claimed is:

1. A gazebo cover adaptable for gazebos having different sized canopies, comprising:

(a) a fabric panel having a central opening and a perimeter defining at least three adjacent perimeter portions;

(b) the fabric panel including a plurality of centrally-converging gussets extending between the perimeter and the central opening;

(c) a closure secured to the fabric panel along the length of the gusset for selectively opening the gussets to form a relatively large canopy sized to fit a predetermined large size canopy frame, and for selectively closing the gussets to form a relatively small canopy sized to fit a predetermined small size canopy frame;

(d) a peak cap for being positioned over and attached to the central opening of the fabric panel for closing the central opening; and (e) straps secured to centers of the gussets for securing the fabric panel to the large size canopy frame when the relatively large canopy is formed.

2. A gazebo cover according to claim 1, wherein the closure comprises a continuously extending closure.

3. A gazebo cover according to claim 2, wherein the closure comprises a zipper.

4. A gazebo cover according to claim 1, wherein the peak cap comprises relatively central connectors for attaching the peak cap to complementary connectors attached to the fabric panel when the relatively small canopy is formed and relatively peripheral connectors for attaching the peak cap to the complementary connectors when the relatively large canopy is formed.

5. A gazebo cover according to claim 4, wherein the peak cap comprises stress-spreading panels attaching the relatively central connectors and the relatively peripheral connectors to the peak cap.

6. A gazebo cover according to claim 5, wherein the stress-spreading panels are three sided, each having a wide base attached to the peak cap for spreading forces applied to the peak cap and a free narrow end attached to its respective one of the central connectors and the peripheral connectors.

7. A gazebo cover according to claim 1, further comprising straps secured to edges of the gussets for gathering the gussets when the relatively small canopy is formed.

8. A gazebo cover adaptable for gazebos having different sized canopies, comprising:

(a) a fabric panel having a central opening and a perimeter defining at least three adjacent perimeter portions;

(b) the fabric panel including a plurality of centrally-converging gussets extending between the perimeter and the central opening;

(c) a closure secured to the fabric panel along the length of the gusset for selectively opening the gussets to form a relatively large canopy sized to fit a predetermined large size canopy frame, and for selectively closing the gussets to form a relatively small canopy sized to fit a predetermined small size canopy frame;

(d) a peak cap for being positioned over the central opening of the fabric panel for closing the central opening;

(e) relatively central connectors secured to the peak cap for attaching the peak cap to the fabric panel when the relatively small canopy is formed;

(f) relatively peripheral connectors secured to the peak cap for attaching the peak cap to the fabric panel when the relatively large canopy is formed; and (g) stress-spreading panels attaching the relatively central connectors and the relatively peripheral connectors to the peak cap.

9. A gazebo cover according to claim 8, further comprising complementary connectors secured to the fabric panel for connecting to the relatively central connectors to attach the peak cap to the fabric panel when the relatively small canopy is formed and for connecting to the relatively peripheral connectors to attach the peak cap to the fabric panel when the relatively large canopy is formed.

10. A gazebo cover according to claim 9, wherein there is one complementary connector between any two nearest gussets.

11. A gazebo cover according to claim 8, wherein the stress-spreading panels are three sided, each having a wide base attached to the peak cap for spreading forces applied to the peak cap and a free narrow end attached to a connector.

12. A gazebo cover according to claim 8, wherein each stress-spreading panel is secured to the fabric panel along one of its three sides and one of the connectors at a junction of its other two sides.

13. A gazebo cover adaptable for gazebos having different sized canopies, comprising:

(a) a fabric panel having a central opening and a perimeter defining at least three adjacent perimeter portions;

(b) the fabric panel including a plurality of centrally-converging gussets extending between the perimeter and the central opening;

(c) a closure secured to the fabric panel along the length of the gusset for selectively opening the gussets to form a relatively large canopy sized to fit a predetermined large size canopy frame, and for selectively closing the gussets to form a relatively small canopy sized to fit a predetermined small size canopy frame;

(d) a peak cap for being positioned over and attached to the central opening of the fabric panel for closing the central opening;

(e) straps secured to edges of the gussets for gathering the gussets when the relatively small canopy is formed; and (f) straps secured to the centers of the gussets for securing the fabric panel to the large size canopy frame when the relatively large canopy is formed.

14. A gazebo cover according to claim 13, wherein the straps comprise hook and loop fabric.

15. A gazebo cover according to claim 13, wherein the straps are positioned as opposing pairs.

16. A gazebo cover according to claim 13, wherein the straps secured to the edges of the gussets are long enough to gather the gussets and secure the fabric panel to the small size canopy frame.

17. A gazebo cover according to claim 13, further comprising straps secured to the center of the peak cap for securing the peak cap to the small size canopy frame or the large size canopy frame.

* * * * *